US011988428B2

(12) United States Patent
Foran et al.

(10) Patent No.: US 11,988,428 B2
(45) Date of Patent: May 21, 2024

(54) LOW REFRIGERANT CHARGE DETECTION IN TRANSPORT REFRIGERATION SYSTEM

(71) Applicant: Carrier Corporation, Palm Beach Gardens, FL (US)

(72) Inventors: Aaron J. Foran, Cicero, NY (US); KeonWoo Lee, Manlius, NY (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 15/733,855

(22) PCT Filed: May 6, 2020

(86) PCT No.: PCT/US2020/031626

§ 371 (c)(1),
(2) Date: Nov. 30, 2020

(87) PCT Pub. No.: WO2020/242736

PCT Pub. Date: Dec. 3, 2020

(65) Prior Publication Data

US 2022/0120483 A1 Apr. 21, 2022

Related U.S. Application Data

(60) Provisional application No. 62/852,454, filed on May 24, 2019.

(51) Int. Cl.
*F25B 49/02* (2006.01)
*F25B 9/00* (2006.01)

(52) U.S. Cl.
CPC ..... *F25B 49/02* (2013.01); *F25B 9/008* (2013.01); *F25B 2700/13* (2013.01); *F25B 2700/2106* (2013.01)

(58) Field of Classification Search
CPC ..... F25B 49/02; F25B 9/008; F25B 2700/13; F25B 2700/2106; F25B 2700/04;
(Continued)

(56) References Cited

U.S. PATENT DOCUMENTS 5,044,168 A * 9/1991 Wycoff ..... G01F 23/14 62/126
5,243,829 A 9/1993 Bessler
(Continued)

FOREIGN PATENT DOCUMENTS

CN 101065622 B 2/2012
CN 107042747 A 8/2017
(Continued)

OTHER PUBLICATIONS

WO-2020230641-A1 English Translation (Year: 2020).*
(Continued)

*Primary Examiner* — David J Teitelbaum
*Assistant Examiner* — Devon Moore
(74) *Attorney, Agent, or Firm* — CANTOR COLBURN LLP

(57) ABSTRACT

A transport refrigeration system includes a compressor, a heat rejection heat exchanger, a flash tank, an expansion device and a heat absorption heat exchanger arranged in a serial refrigerant flow order to circulate a refrigerant; a controller configured to: determine a presence of at least one condition of the transport refrigeration system; and initiate a low refrigerant charge detection process in response to detecting the presence of the at least one condition of the transport refrigeration system.

15 Claims, 5 Drawing Sheets

(58) Field of Classification Search
CPC ..... F25B 2500/22; F25B 2500/221; F25B 2500/222; F25B 2600/05
See application file for complete search history.

(56) References Cited

U.S. PATENT DOCUMENTS

| | | | | |
|---|---|---|---|---|
| 6,233,952 | B1 * | 5/2001 | Porter | F25D 29/003 62/131 |
| 6,397,613 | B1 | 6/2002 | Izawa et al. | |
| 6,460,354 | B2 | 10/2002 | Yabuki et al. | |
| 6,964,173 | B2 | 11/2005 | Dobmeier et al. | |
| RE42,006 | E | 12/2010 | Pham et al. | |
| 8,109,105 | B2 | 2/2012 | Unezaki et al. | |
| 9,188,376 | B2 | 11/2015 | Tamaki et al. | |
| 9,347,715 | B2 | 5/2016 | Schreiber et al. | |
| 9,869,499 | B2 | 1/2018 | Liu et al. | |
| 10,088,202 | B2 | 10/2018 | Huff et al. | |
| 10,527,332 | B2 | 1/2020 | Connell et al. | |
| 2002/0083723 | A1 * | 7/2002 | Demuth | B60H 1/3225 62/225 |
| 2004/0083744 | A1 | 5/2004 | Harte | |
| 2007/0107461 | A1 | 5/2007 | Ohta et al. | |
| 2007/0266717 | A1 | 11/2007 | Goodremote et al. | |
| 2011/0100040 | A1 * | 5/2011 | Bush | F25B 45/00 62/149 |

FOREIGN PATENT DOCUMENTS

| | | | | |
|---|---|---|---|---|
| EP | 2812640 | A2 | 12/2014 | |
| GB | 2546657 | A * | 7/2017 | F24F 11/36 |
| KR | 20070033215 | A | 3/2007 | |
| KR | 1261046 | B1 | 5/2013 | |
| WO | 2005059446 | A2 | 6/2005 | |
| WO | WO-2013016404 | A1 * | 1/2013 | F25B 1/10 |
| WO | 2015111222 | A1 | 7/2015 | |
| WO | WO-2020230641 | A1 * | 11/2020 | F25B 49/02 |

OTHER PUBLICATIONS

Supercritical CO2 Tech Team (NPL-1) (Year: 2014).*
International Search Report and Written Opinion for International Application Serial No. PCT/US2020/031626; International Filing Date May 6, 2020; Report dated Aug. 24, 2020 (pp. 1-32).

* cited by examiner

LOW REFRIGERANT CHARGE DETECTION IN TRANSPORT REFRIGERATION SYSTEM

CROSS REFERENCE TO RELATED APPLICATIONS

This application is a US National Stage of International Application No. PCT/US2020/031626 filed May 6, 2020, which claims the benefit of U.S. Application No. 62/852,454, filed on May 24, 2019, which are incorporated herein by reference in their entirety.

BACKGROUND

This disclosure relates generally to transport refrigeration systems and, more particularly, to the detection of low refrigerant charge in a transport refrigeration system.

Refrigerant vapor compression systems are commonly used in mobile refrigeration systems, such as transport refrigeration systems, for refrigerating air or other gaseous fluid supplied to a temperature controlled cargo space of a truck, trailer, container, or the like, for transporting perishable items, fresh or frozen, by truck, rail, ship or intermodal.

Conventional refrigerant vapor compression systems used in transport refrigeration systems typically include a compressor, a refrigerant heat rejection heat exchanger, and a refrigerant heat absorption heat exchanger arranged in a closed loop refrigerant circuit. An expansion device, commonly an expansion valve, is disposed in the refrigerant circuit upstream, with respect to refrigerant flow, of the refrigerant heat absorption heat exchanger and downstream of the refrigerant heat rejection heat exchanger. These basic refrigerant vapor compression system components are interconnected by refrigerant lines and are arranged in accordance with known refrigerant vapor compression cycles. Refrigerant vapor compression systems may be operated in either a subcritical pressure regime or a transcritical pressure regime depending upon the particular refrigerant in use.

Different types of refrigeration systems may utilize different refrigerants and operate at different pressures. One type of refrigeration system is a transcritical refrigeration system that may use CO2 as a refrigerant (e.g., R-744). Such systems typically operate at high pressures which may range from 1000 psi to 1800 psi. The higher the operating pressure, the higher may be the risk of a refrigerant leak. All refrigeration systems are sensitive to loss of refrigerant charge and may lose operating efficiency or cease operating altogether.

SUMMARY

According to an embodiment, a transport refrigeration system includes a compressor, a heat rejection heat exchanger, a flash tank, an expansion device and a heat absorption heat exchanger arranged in a serial refrigerant flow order to circulate a refrigerant; a controller configured to: determine a presence of at least one condition of the transport refrigeration system; and initiate a low refrigerant charge detection process in response to detecting the presence of the at least one condition of the transport refrigeration system.

In addition to one or more of the features described herein, or as an alternative, further embodiments may include wherein the at least one condition comprises a relationship of an ambient air temperature to a critical point of the refrigerant.

In addition to one or more of the features described herein, or as an alternative, further embodiments may include wherein the controller initiates a standstill test when the ambient air temperature is greater than the critical point of the refrigerant.

In addition to one or more of the features described herein, or as an alternative, further embodiments may include wherein the standstill test is performed with the compressor powered off.

In addition to one or more of the features described herein, or as an alternative, further embodiments may include wherein the standstill test comprises determining a pressure and a temperature of the transport refrigeration system.

In addition to one or more of the features described herein, or as an alternative, further embodiments may include wherein the standstill test comprises determining a density of the refrigerant in response to the pressure and the temperature.

In addition to one or more of the features described herein, or as an alternative, further embodiments may include wherein the standstill test comprises determining a refrigerant charge in response to the density of the refrigerant and a volume of the transport refrigeration system.

In addition to one or more of the features described herein, or as an alternative, further embodiments may include wherein the standstill test comprises comparing the refrigerant charge to a threshold to detect a low refrigerant charge.

In addition to one or more of the features described herein, or as an alternative, further embodiments may include wherein the controller initiates the standstill test when the ambient air temperature is greater than the critical point of the refrigerant by a margin.

In addition to one or more of the features described herein, or as an alternative, further embodiments may include wherein the controller initiates a dynamic test when the ambient air temperature is less than the critical point of the refrigerant.

In addition to one or more of the features described herein, or as an alternative, further embodiments may include wherein the dynamic test is performed with the compressor powered on.

In addition to one or more of the features described herein, or as an alternative, further embodiments may include wherein the dynamic test comprises determining an ambient air temperature.

In addition to one or more of the features described herein, or as an alternative, further embodiments may include wherein the dynamic test comprises determining a flash tank pressure in the flash tank.

In addition to one or more of the features described herein, or as an alternative, further embodiments may include wherein the dynamic test comprises determining a refrigerant charge in response to the ambient air temperature and the flash tank pressure.

In addition to one or more of the features described herein, or as an alternative, further embodiments may include wherein the dynamic test comprises comparing the refrigerant charge to a threshold to detect a low refrigerant charge.

In addition to one or more of the features described herein, or as an alternative, further embodiments may include wherein the controller initiates the dynamic test when the ambient air temperature is not greater than the critical point of the refrigerant by a margin.

In addition to one or more of the features described herein, or as an alternative, further embodiments may include wherein the refrigerant is carbon dioxide.

According to another embodiment, a method of detecting a low refrigerant charge in transport refrigeration system including a compressor, the method including determining an ambient air temperature; comparing the ambient air temperature to a critical point of the refrigerant; initiating a standstill test with the compressor powered off when the ambient air temperature is greater than the critical point of the refrigerant; initiating a dynamic test with the compressor powered on when at least one of (i) the ambient air temperature is less than the critical point of the refrigerant or (ii) the ambient air temperature is not greater than the critical point of the refrigerant by a margin.

According to another embodiment, a computer program product for detecting a low refrigerant charge in transport refrigeration system including a compressor, the computer program product comprising a non-transitory computer readable storage medium having program instructions embodied therewith, the program instructions executable by a processor to cause the processor to implement operations including: determining an ambient air temperature; comparing the ambient air temperature to a critical point of the refrigerant; initiating a standstill test with the compressor powered off when the ambient air temperature is greater than the critical point of the refrigerant; initiating a dynamic test with the compressor powered on when at least one of (i) the ambient air temperature is less than the critical point of the refrigerant or (ii) the ambient air temperature is not greater than the critical point of the refrigerant by a margin.

Technical effects of embodiments of the present disclosure include the ability to check for suitable refrigerant charge in a transport refrigeration system as part of a pre-trip inspection.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

For a further understanding of the disclosure, reference will be made to the following detailed description which is to be read in connection with the accompanying drawings, where.

DETAILED DESCRIPTION

Figure 1:
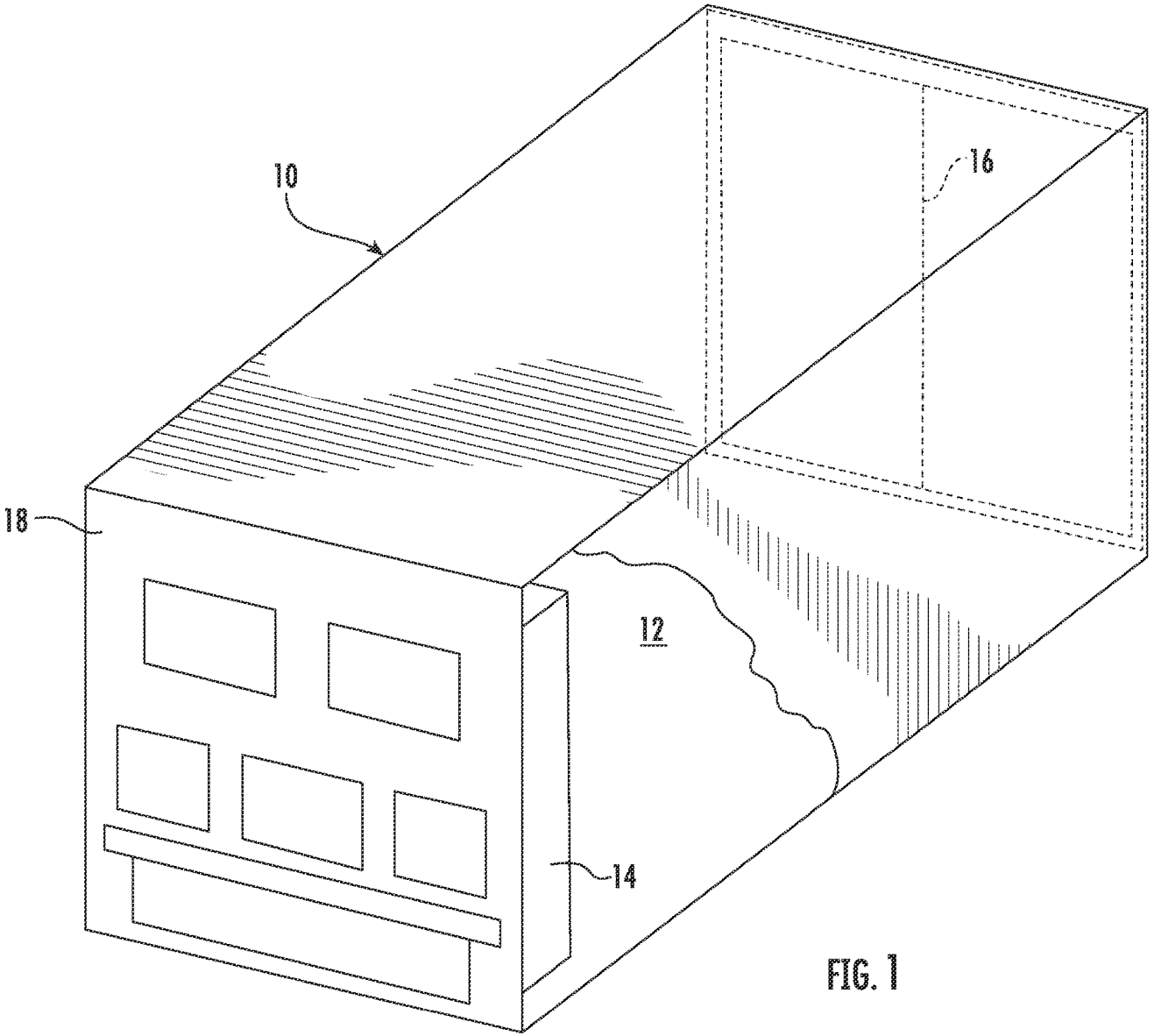
FIG. 1 depicts a refrigerated container utilizing a transport refrigeration system in an example embodiment.

FIG. 1 depicts a refrigerated container 10 having a temperature controlled cargo space 12, the atmosphere of which is refrigerated by operation of a transport refrigeration unit 14 associated with the cargo space 12. In the depicted embodiment of the refrigerated container 10, the transport refrigeration unit 14 is mounted in a wall of the refrigerated container 10, typically in the front wall 18 in conventional practice. However, the transport refrigeration unit 14 may be mounted in the roof, floor or other walls of the refrigerated container 10. Additionally, the refrigerated container 10 has at least one access door 16 through which perishable goods, such as, for example, fresh or frozen food products, may be loaded into and removed from the cargo space 12 of the refrigerated container 10.

Figure 2:
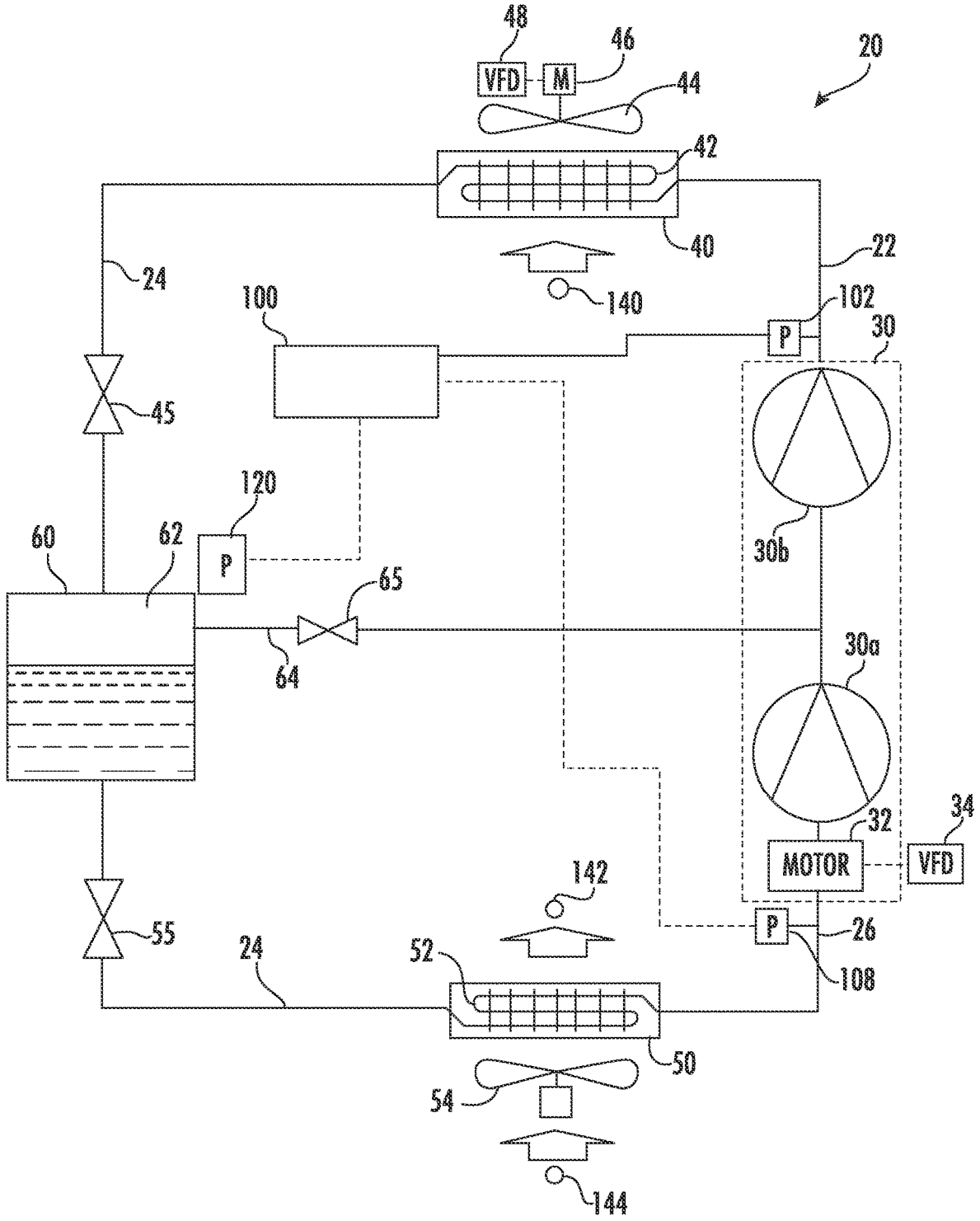
FIG. 2 depicts a transport refrigeration system in an example embodiment.

FIG. 2 depicts a transport refrigeration system 20 suitable for use in the transport refrigeration unit 14 for refrigerating air drawn from and supplied back to the temperature controlled cargo space 12. Although the transport refrigeration system 20 will be described herein in connection with a refrigerated container 10 of the type commonly used for transporting perishable goods by ship, by rail, by land or intermodally, it is to be understood that the transport refrigeration system 20 may also be used in transport refrigeration units for refrigerating the cargo space of a truck, a trailer or the like for transporting perishable fresh or frozen goods. The transport refrigeration system 20 is also suitable for use in conditioning air to be supplied to a climate controlled comfort zone within a residence, office building, hospital, school, restaurant or other facility. The transport refrigeration system 20 could also be employed in refrigerating air supplied to display cases, merchandisers, freezer cabinets, cold rooms or other perishable and frozen product storage areas in commercial establishments.

The transport refrigeration system 20 may include a compressor 30, that may be multi-stage, a heat rejection heat exchanger 40, a flash tank 60, a heat absorption heat exchanger 50, and refrigerant lines 22, 24 and 26 connecting the aforementioned components in a serial refrigerant flow order in a primary refrigerant circuit. A secondary expansion device 45, such as, for example, an electronic expansion valve, is disposed in refrigerant line 24 upstream of the flash tank 60 and downstream of the heat rejection heat exchanger 40. A primary expansion device 55, such as, for example, an electronic expansion valve, operatively associated with the heat absorption heat exchanger 50, is disposed in refrigerant line 24 downstream of the flash tank 60 and upstream of the heat absorption heat exchanger 50.

The compressor 30 functions to compress the refrigerant and to circulate refrigerant through the primary refrigerant circuit, and may be a single, multiple-stage refrigerant compressor (e.g., a reciprocating compressor or a scroll compressor) having a first compression stage 30*a* and a second stage 30*b*, wherein the refrigerant discharging from the first compression stage 30*a* passes to the second compression stage 30*b* for further compression. Alternatively, the compressor 30 may comprise a pair of individual compressors, one of which constitutes the first compression stage 30*a* and other of which constitutes the second compression stage 30*b*, connected in series refrigerant flow relationship in the primary refrigerant circuit via a refrigerant line connecting the discharge outlet port of the compressor constituting the first compression stage 30*a* in refrigerant flow communication with the suction inlet port of the compressor constituting the second compression stage 30*b* for further compression. In a two compressor embodiment, the compressors may be scroll compressors, screw compressors, reciprocating compressors, rotary compressors or any other type of compressor or a combination of any such compressors. In both embodiments, in the first compression stage 30*a*, the refrigerant vapor is compressed from a lower pressure to an intermediate pressure and in the second compression stage 30*b*, the refrigerant vapor is compressed from an intermediate pressure to higher pressure.

The compressor 30 may be driven by a variable speed motor 32 powered by electric current delivered through a variable frequency drive 34. The electric current may be supplied to the variable speed drive 34 from an external power source (not shown), such as for example a ship board power plant, or from a fuel-powered engine drawn generator unit, such as a diesel engine driven generator set, attached to the front of the container. The speed of the variable speed compressor 30 may be varied by varying the frequency of the current output by the variable frequency drive 34 to the compressor drive motor 32. It is to be understood, however, that the compressor 30 could in other embodiments comprise a fixed speed compressor.

The heat rejection heat exchanger 40 may comprise a finned tube heat exchanger 42 through which hot, high pressure refrigerant discharged from the second compression stage 30*b* passes in heat exchange relationship with a secondary fluid, most commonly ambient air drawn through the heat rejection heat exchanger 40 by the fan(s) 44. The heat rejection heat exchanger 40 may comprise, for example, a fin and round tube heat exchange coil or a fin and flat mini-channel tube heat exchanger. In the depicted embodiment, a variable speed motor 46 powered by a variable frequency drive 48 drives the fan(s) 44 associated with the heat rejection heat exchanger 40.

When the transport refrigeration system 20 operates in a transcritical cycle, the pressure of the refrigerant discharging from the second compression stage 30*b* and passing through the heat rejection heat exchanger 40, referred to herein as the high side pressure, exceeds the critical point of the refrigerant, and the heat rejection heat exchanger 40 functions as a gas cooler. In an example embodiment, the refrigerant is carbon dioxide, also known as R744. However, it should be understood that if the transport refrigeration system 20 operates solely in the subcritical cycle, the pressure of the refrigerant discharging from the compressor and passing through the heat rejection heat exchanger 40 is below the critical point of the refrigerant, and the heat rejection heat exchanger 40 functions as a condenser.

The heat absorption heat exchanger 50 may also comprise a finned tube coil heat exchanger 52, such as a fin and round tube heat exchanger or a fin and flat, mini-channel tube heat exchanger. Whether the refrigeration system is operating in a transcritical cycle or a subcritical cycle, the heat absorption heat exchanger 50 functions as a refrigerant evaporator. Before entering the heat absorption heat exchanger 50, the refrigerant passing through refrigerant line 24 traverses the primary expansion device 55, such as, for example, an electronic expansion valve or a thermostatic expansion valve, and expands to a lower pressure and a lower temperature to enter heat absorption heat exchanger 50. As the liquid refrigerant traverses the heat absorption heat exchanger 50, the liquid refrigerant passes in heat exchange relationship with a heating fluid whereby the liquid refrigerant is evaporated and typically superheated to a desired degree. The low pressure vapor refrigerant leaving heat absorption heat exchanger 50 passes through refrigerant line 26 to the suction inlet of the first compression stage 30*a*. The heating fluid may be air drawn by an associated fan(s) 54 from a climate controlled environment, such as a perishable/frozen cargo space associated with a transport refrigeration unit, or a food display or storage area of a commercial establishment, or a building comfort zone associated with an air conditioning system, to be cooled, and generally also dehumidified, and thence returned to a climate controlled environment.

The flash tank 60, which is disposed in refrigerant line 24 between the heat rejection heat exchanger 40 and the heat absorption heat exchanger 50, upstream of the primary expansion device 55 and downstream of the secondary expansion device 45, functions as an economizer and a receiver. The flash tank 60 defines a chamber 62 into which expanded refrigerant having traversed the secondary expansion device 45 enters and separates into a liquid refrigerant portion and a vapor refrigerant portion. The liquid refrigerant collects in the chamber 62 and is metered therefrom through the downstream leg of refrigerant line 24 by the primary expansion device 55 to flow through the heat absorption heat exchanger 50.

The vapor refrigerant collects in the chamber 62 above the liquid refrigerant and may pass therefrom through economizer vapor line 64 for injection of refrigerant vapor into an intermediate stage of the compression process. An economizer flow control device or valve 65, such as, for example, a solenoid valve (ESV) having an open position and a closed position, is interposed in the economizer vapor line 64. When the transport refrigeration system 20 is operating in an economized mode, the economizer flow control device 65 is opened thereby allowing refrigerant vapor to pass through the economizer vapor line 64 from the flash tank 60 into an intermediate stage of the compressor 30. When the transport refrigeration system 20 is operating in a standard, non-economized mode, the economizer flow control device 65 is closed thereby preventing refrigerant vapor to pass through the economizer vapor line 64 from the flash tank 60 into an intermediate stage of the compressor 30.

In an embodiment where the compressor 30 has two compressors connected in serial flow relationship by a refrigerant line, one being a first compression stage 30*a* and the other being a second compression stage 30*b*, the vapor injection line 64 communicates with refrigerant line interconnecting the outlet of the first compression stage 30*a* to the inlet of the second compression stage 30*b*. In an embodiment where the compressor 30 comprises a single compressor having a first compression stage 30*a* feeding a second compression stage 30*b*, the refrigerant vapor injection line 64 may open directly into an intermediate stage of the compression process through a dedicated port opening into the compression chamber.

A controller 100 controls operation of the transport refrigeration system 20. The controller 100 may be implemented using components such as microprocessors, microcontrollers, programmed digital signal processors, integrated circuits, computer hardware, computer software, electrical circuits, application specific integrated circuits, programmable logic devices, programmable gate arrays, programmable array logic, personal computers, chips, and any other combination of discrete analog, digital, or programmable components, or other devices capable of providing processing functions. The controller 100 includes a memory, in which program instructions and data may be stored. The controller 100 executes the program instructions to perform the operations described herein.

The controller 100 may control opening and closing of economizer flow control device 65, depending on whether economized mode is desired. The controller 100 may also control the primary expansion device 55 and the secondary expansion device 45, in embodiments where the primary expansion device 55 and the secondary expansion device 45 are electronically controlled.

The controller 100 also monitors various pressures and temperatures and operating parameters by means of various sensors operatively associated with the controller 100 and disposed at selected locations throughout the transport refrigeration system 20. An ambient air temperature sensor 140 provides the ambient air temperature, TA, to the controller 100. The ambient air temperature sensor 140 may be located in the air stream passing over the heat rejection heat exchanger 40, upstream of the heat rejection heat exchanger 40. A supply air temperature sensor 142 provides the supply air temperature, TS, (e.g., temperature of air supplied to the cargo space 12) to the controller 100. The supply air temperature sensor 142 may be located in the air stream passing over the heat absorption heat exchanger 50, downstream of the heat absorption heat exchanger 50. A return air temperature sensor 144 provides the return air temperature (e.g., temperature of air returned from the cargo space 12), TR, to the controller 100. The return air temperature sensor 144 may be located in the air stream passing over the heat absorption heat exchanger 50, upstream of the heat absorption heat exchanger 50.

A discharge pressure sensor 102 may be disposed in association with the compressor 30 for measuring discharge pressure, PD, or may be disposed in association with the heat rejection heat exchanger 40 to sense the pressure of the refrigerant at the outlet of the heat rejection heat exchanger 40, which pressure is equivalent to the discharge pressure, PD. A suction pressure sensor 108 may be disposed in association with the suction inlet of the first compression stage 30*a* to sense the suction pressure, PS, of the refrigerant supplied to the compressor 30. A flash tank pressure sensor 120 may be disposed in the flash tank 60 to sense the pressure, PF, of the refrigerant in the flash tank 60. The pressure sensors 102, 108 and 120 may be conventional pressure sensors, such as for example, pressure transducers. The temperature sensors 140, 142 and 144 may be conventional temperature sensors, such as for example, thermocouples or thermistors.

Figure 3:
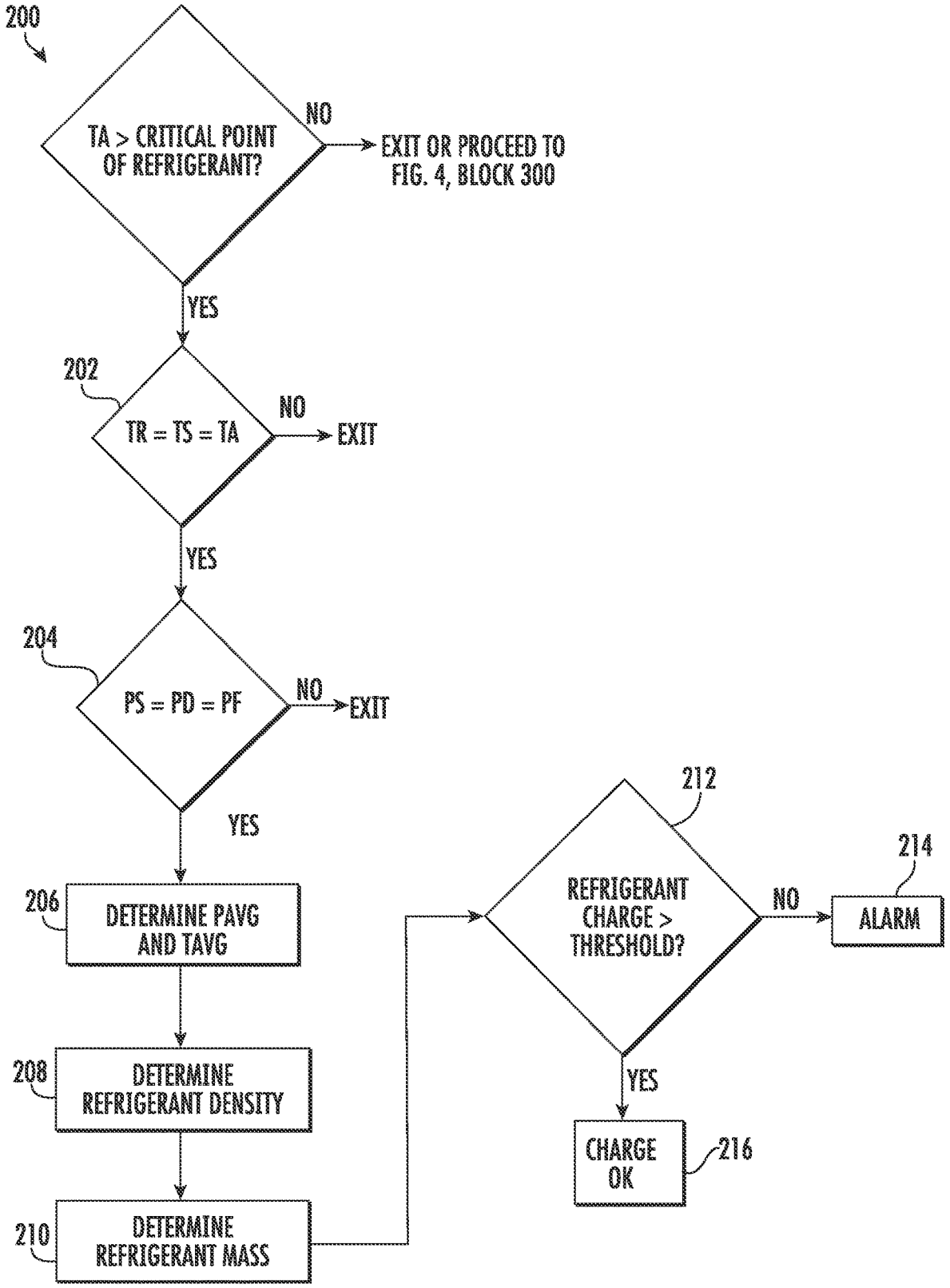
FIG. 3 depicts a standstill test for determining refrigerant charge in an example embodiment.
Figure 4:
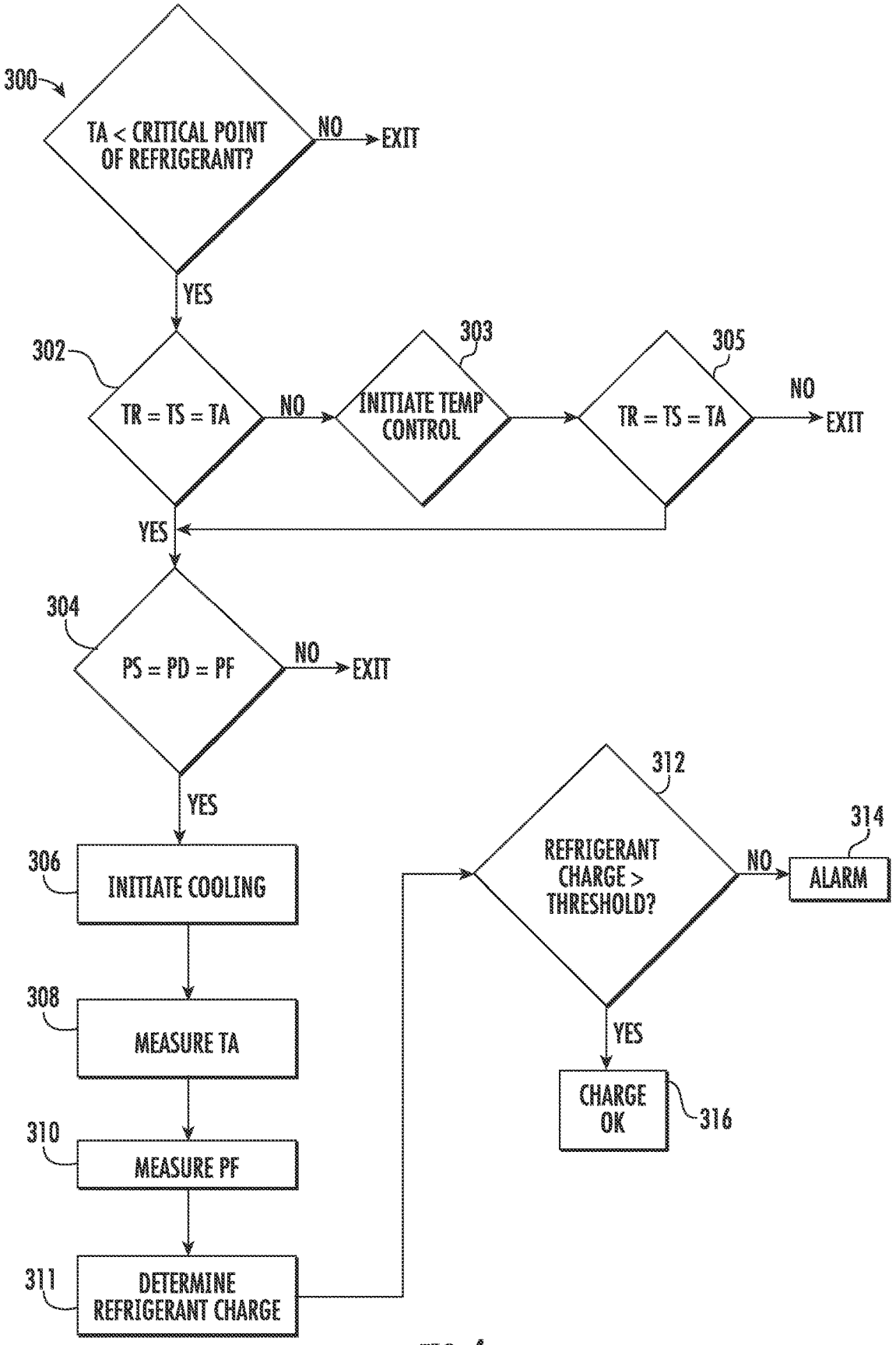
FIG. 4 depicts a dynamic test for determining refrigerant charge in an example embodiment.

The controller 100 performs a low refrigerant charge detection process, which may occur as part of a pre-trip inspection. The low refrigerant charge detection process may include two tests. A first test is a standstill test, with the transport refrigeration system 20 powered off (e.g., the compressor 30 is powered off). FIG. 3 depicts a flowchart of the standstill test. The ability to perform the standstill test is dependent on the presence of at least one condition, the conditions determined in blocks 200, 202 and 204. At block 200, the controller 100 determines if the ambient temperature, TA, is greater than the critical point of the refrigerant. Block 200 may include determining that the ambient temperature, TA, is greater than the critical point of the refrigerant by a margin (e.g., 5 degrees F.). If not, the process exits or may proceed to the second test as shown in FIG. 4.

If the ambient temperature, TA, is greater than the critical point of the refrigerant (optionally by a margin), flow proceeds to block 202. At block 202, the controller 100 determines if the internal cargo space air temperature is equal to the ambient air temperature, within a tolerance (e.g., plus/minus 15-20 degrees F.). This may be performed by comparing the TR, TS and TA. If the internal cargo space air temperature is not equal to the ambient air temperature, the process exits. If the internal cargo space air temperature is equal to the ambient air temperature, flow proceeds to block 204. At block 204, the controller 100 determines if the refrigerant pressures within the transport refrigeration system 20 are stable and equal within a tolerance (e.g., plus/minus one psi). This may be performed by comparing the suction pressure, PS, the discharge pressure, PD, and the flash tank pressure, PF. If the refrigerant pressures within the transport refrigeration system 20 are not stable and equal within a tolerance, the process exits.

If the refrigerant pressures within the transport refrigeration system 20 are stable and equal within a tolerance, flow proceeds to block 206. At this point, the three conditions of blocks 200, 202 and 204 are met. At block 206, the controller 100 determines an average system pressure and average system temperature. The average system pressure may be computed by averaging PS, PD and PF. The average system temperature may be computed by averaging TA, TS and TR. At block 208, the controller 100 determines the density of the refrigerant using the average system pressure, average system temperature and properties of the refrigerant. At block 210, the controller 100 determines the mass of the refrigerant (e.g., the refrigerant charge) using density of the refrigerant and a known volume of the refrigeration system 20.

At block 212, the controller 100 compares the refrigerant charge to a threshold. If the refrigerant charge is greater than the threshold, the refrigerant charge is determined to be acceptable at block 216. If the refrigerant charge is not greater than the threshold, the refrigerant charge is determined to be unacceptable at block 214. An alarm may be generated at block 214 to indicate the low refrigerant charge.

A second test of the low refrigerant charge detection process is a dynamic test. FIG. 4 depicts a flowchart of the dynamic test. The ability to perform the dynamic test is dependent on the presence of at least one condition, the conditions determined in blocks 300, 302 and 304. At block 300, the controller 100 determines if the ambient temperature, TA, is equal to or less than the critical point of the refrigerant. Block 300 may include determining that the ambient temperature, TA, is not greater than the critical point of the refrigerant by a margin (e.g., 5 degrees F.). If not, the process exits. If the ambient temperature, TA, is equal to or less than the critical point of the refrigerant (optionally, not greater than the critical point by a margin), flow proceeds to block 302. At block 302, the controller 100 determines if the internal cargo space air temperature is equal to the ambient air temperature, within a tolerance (e.g., plus/minus 15-20 degrees F.). This may be performed by comparing the TR, TS and TA. If the internal cargo space air temperature is not equal to the ambient air temperature, flow proceeds to block 303 where the controller 100 powers on the transport refrigeration system 20 to operate for a period of time necessary to equalize the internal cargo space air temperature to the ambient air temperature. After the period of time, flow proceeds to block 305 where the controller 100 again checks if the internal cargo space air temperature is equal to the ambient air temperature, within a tolerance (e.g., plus/minus 15-20 degrees F.). This may be performed by comparing the TR, TS and TA. If the internal cargo space air temperature is not equal to the ambient air temperature, the process exits.

If at block 305, the internal cargo space air temperature is equal to the ambient air temperature, flow proceeds to block 304. At block 304, the controller 100 determines if the refrigerant pressures within the transport refrigeration system 20 are stable and equal within a tolerance (e.g., plus/minus one psi). This may be performed by comparing the suction pressure, PS, the discharge pressure, PD, and the flash tank pressure, PF. If the refrigerant pressures within the transport refrigeration system 20 are not stable and equal within a tolerance, the process exits.

If the refrigerant pressures within the transport refrigeration system 20 are stable and equal within a tolerance, flow proceeds to block 306. At this point, the three conditions of blocks 300, 302 and 304 are met. At block 306, the controller 100 initiates a cooling cycle by entering a controlled pull down mode to cool the cargo space 12 (e.g., the compressor 30 is powered on). Under the condition that the transport refrigeration system 20 is operating with a low refrigerant charge, the following responses will predictably occur relative to normal operating conditions: (i) heat absorption heat exchanger 50 refrigerant superheat will increase, (ii) the primary expansion device 55 will open, and (iii) the flash tank 60 pressure, PF, will decrease. Responses (i) through (iii) can be measured and directly relate to system refrigerant charge and ambient air temperature. The flash tank pressure, PF, may be measured relative to ambient air temperature, TA, and used as an accurate charge determination variable.

Figure 5:
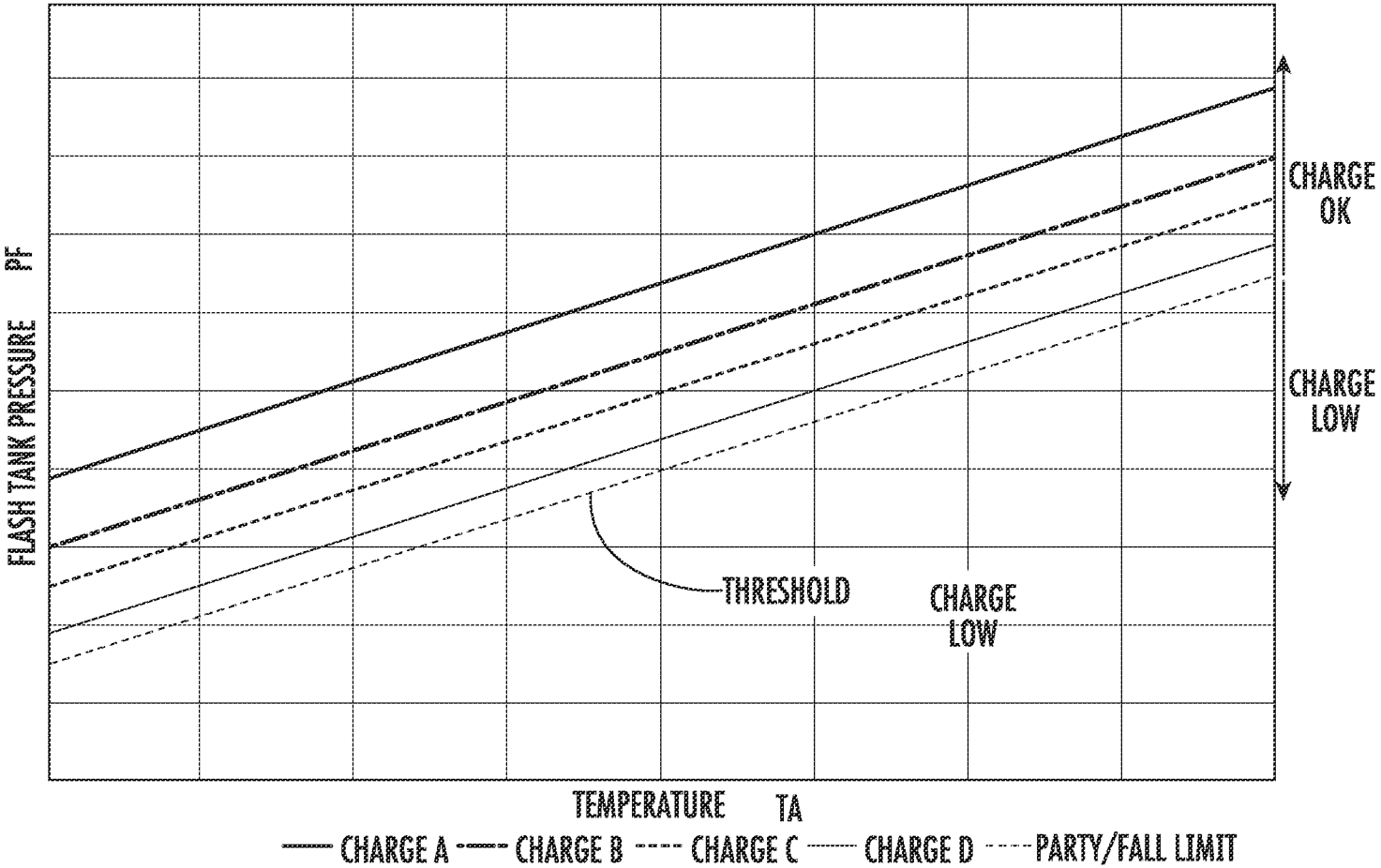
FIG. 5 depicts plots of refrigerant charge versus ambient air temperature and flash tank pressure in an example embodiment.

After the controlled cooling sequence is completed at block 306 (e.g., the cargo space 12 reaches a setpoint temperature), flow proceeds to block 308 where the controller 100 obtains the ambient air temperature, TA. At 310, the controller obtains the flash tank pressure, PF. At block 311, the controller 100 determines the refrigerant charge in response to the ambient air temperature, TA, and the flash tank pressure, PF. FIG. 5 depicts example plots of refrigerant charges for values of ambient air temperature, TA, versus flash tank pressure, PF. The controller 100 uses the ambient air temperature, TA, obtained at block 308 and the flash tank pressure, PF, obtained at block 310 to determine the refrigerant charge at block 311. The dashed line indicates a threshold, below which a low refrigerant charge is detected.

Referring to FIG. 4, at block 312, the controller 100 compares the refrigerant charge to the threshold (i.e., the dashed line in FIG. 5). If the refrigerant charge is greater than the threshold, the refrigerant charge is determined to be acceptable at block 316. If the refrigerant charge is not greater than the threshold, the refrigerant charge is determined to be unacceptable at block 314. An alarm may be generated at block 314 to indicate the low refrigerant charge level.

Embodiments provide a technique to determine refrigerant charge in a refrigeration system of a transport refrigeration unit. The determination of refrigerant charge may be performed as part an automatic pre-trip inspection cycle, prior to transporting the container including the transport refrigeration unit. The process may also be initiated by an operator or technician as a means of effective failure analysis.

As described above, embodiments can be in the form of processor-implemented processes and devices for practicing those processes, such as a processor in controller 100. Embodiments can also be in the form of computer program code containing instructions embodied in tangible media, such as network cloud storage, SD cards, flash drives, floppy diskettes, CD ROMs, hard drives, or any other computer-readable storage medium. Embodiments can also be in the form of computer program code transmitted over some transmission medium, such as over electrical wiring or cabling, through fiber optics, or via electromagnetic radiation. When implemented on a general-purpose microprocessor, the computer program code configures the microprocessor to create specific logic circuits.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

As described herein, in some embodiments various functions or acts may take place at a given location and/or in connection with the operation of one or more apparatuses, systems, or devices. For example, in some embodiments, a portion of a given function or act may be performed at a first device or location, and the remainder of the function or act may be performed at one or more additional devices or locations. Further, one of ordinary skill in the art will appreciate that the steps described in conjunction with the illustrative figures may be performed in other than the recited order, and that one or more steps illustrated may be optional.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, subcombinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A transport refrigeration system comprising:

a compressor, a heat rejection heat exchanger, a flash tank, an expansion device and a heat absorption heat exchanger arranged in a serial refrigerant flow order to circulate a refrigerant;

a controller configured to:

determine a presence of at least one condition of the transport refrigeration system; and initiate a low refrigerant charge detection process in response to detecting the presence of the at least one condition of the transport refrigeration system, wherein the at least one condition comprises a relationship of an ambient air temperature to a critical point of the refrigerant;

wherein the controller initiates a dynamic test as part of the low refrigerant charge detection process when the ambient air temperature is less than the critical point of the refrigerant;

wherein the dynamic test comprises:

determining that an internal cargo space air temperature is equal to the ambient air temperature;

determining that a discharge pressure of the compressor, a suction pressure of the compressor and a flash tank pressure are equal to each other;

upon (i) the internal cargo space air temperature being equal to the ambient air temperature and (ii) the discharge pressure of the compressor, the suction pressure of the compressor and the flash tank pressure are equal to each other, powering on the compressor to initiate a cooling cycle;

determining the refrigerant charge based on a relationship between the ambient air temperature and the flash tank pressure.

2. The transport refrigeration system of claim 1, wherein the controller initiates a standstill test when the ambient air temperature is greater than the critical point of the refrigerant.

3. The transport refrigeration system of claim 2, wherein the standstill test is performed with the compressor powered off.

4. The transport refrigeration system of claim 3, wherein the standstill test comprises determining a pressure and a temperature of the transport refrigeration system.

5. The transport refrigeration system of claim 4, wherein the standstill test comprises determining a density of the refrigerant in response to the pressure and the temperature.

6. The transport refrigeration system of claim 5, wherein the standstill test comprises determining a refrigerant charge in response to the density of the refrigerant and a volume of the transport refrigeration system.

7. The transport refrigeration system of claim 6, wherein the standstill test comprises comparing the refrigerant charge to a threshold to detect a low refrigerant charge.

8. The transport refrigeration system of claim 2, wherein the controller initiates the standstill test when the ambient air temperature is greater than the critical point of the refrigerant by a margin.

9. The transport refrigeration system of claim 1, wherein the dynamic test is performed with the compressor powered on.

10. The transport refrigeration system of claim 1, wherein the dynamic test comprises comparing the refrigerant charge to a threshold to detect a low refrigerant charge.

11. The transport refrigeration system of claim 1 wherein the refrigerant is carbon dioxide.

12. The transport refrigeration system of claim 1, wherein the determining that the internal cargo space air temperature is equal to the ambient air temperature includes determining that the internal cargo space air temperature and the ambient air temperature are within a tolerance of each other.

13. The transport refrigeration system of claim 1, wherein the determining that the discharge pressure of the compressor, the suction pressure of the compressor and the flash tank pressure are equal to each other includes determining that the discharge pressure of the compressor, the suction pressure of the compressor and the flash tank pressure are within a tolerance of each other.

14. A method of detecting a low refrigerant charge in a transport refrigeration system including a compressor, the method comprising:

determining an ambient air temperature;

comparing the ambient air temperature to a critical point of the refrigerant;

initiating a standstill test with the compressor powered off when the ambient air temperature is greater than the critical point of the refrigerant;

initiating a dynamic test with the compressor powered on when the ambient air temperature is less than the critical point of the refrigerant;

wherein the dynamic test comprises:

determining that an internal cargo space air temperature is equal to the ambient air temperature;

determining that a discharge pressure of the compressor, a suction pressure of the compressor and a flash tank pressure are equal to each other;

upon (i) the internal cargo space air temperature being equal to the ambient air temperature and (ii) the discharge pressure of the compressor, the suction pressure of the compressor and the flash tank pressure are equal to each other, powering on the compressor to initiate a cooling cycle;

determining the refrigerant charge based on a relationship between the ambient air temperature and the flash tank pressure.

15. A computer program product for detecting a low refrigerant charge in a transport refrigeration system including a compressor, the computer program product comprising a non-transitory computer readable storage medium having program instructions embodied therewith, the program instructions executable by a processor to cause the processor to implement operations comprising:

determining an ambient air temperature;

comparing the ambient air temperature to a critical point of the refrigerant;

initiating a standstill test with the compressor powered off when the ambient air temperature is greater than the critical point of the refrigerant;

initiating a dynamic test with the compressor powered on when the ambient air temperature is less than the critical point of the refrigerant;

wherein the dynamic test comprises:

determining that an internal cargo space air temperature is equal to the ambient air temperature;

determining that a discharge pressure of the compressor, a suction pressure of the compressor and a flash tank pressure are equal to each other;

upon (i) the internal cargo space air temperature being equal to the ambient air temperature and (ii) the discharge pressure of the compressor, the suction pressure of the compressor and the flash tank pressure are equal to each other, powering on the compressor to initiate a cooling cycle;

determining the refrigerant charge based on a relationship between the ambient air temperature and the flash tank pressure.

* * * * *